United States Patent [19]

Schulz et al.

[11] 4,028,873

[45] June 14, 1977

[54] RING SPINNING OR TWISTING MACHINE

[75] Inventors: Günter Schulz; Wolfgang Igel, both of Ebersbach, Germany

[73] Assignee: Zinser Textilmaschinen GmbH, Ebersbach, Germany

[22] Filed: Aug. 20, 1976

[21] Appl. No.: 716,152

[30] Foreign Application Priority Data

Aug. 29, 1975 Germany ..... 2538420

[52] U.S. Cl. ..... 57/124; 57/78; 57/113

[51] Int. Cl.[2] ..... D01H 7/56

[58] Field of Search ..... 57/119, 122, 124, 113, 57/75, 78

[56] References Cited

UNITED STATES PATENTS

| | | | |
|---|---|---|---|
| 2,796,726 | 6/1957 | Klein | 57/124 X |
| 3,494,120 | 2/1970 | Chilpan et al. | 57/75 |
| 3,785,140 | 1/1974 | Muller | 57/124 X |
| 3,851,448 | 12/1974 | Sand et al. | 57/75 |
| 3,950,931 | 4/1976 | Bleek | 57/113 |

*Primary Examiner*—John Petrakes
*Attorney, Agent, or Firm*—Edwin E. Greigg

[57] ABSTRACT

A ring spinning or twisting machine has rotating rings which are equipped with metallic flanges. Each ring has an associated permanent magnet device which can be moved to the vicinity of the flange so that the magnetic field interacts with it and generates eddy currents which tend to decelerate the rotating ring. The permanent magnets are mounted on a common sliding rod which is actuated by a servomotor. The displacement is such that each magnet moves substantially parallel to the plane of the flange and may occupy a position where the magnetic field is laterally adjacent to the flange and does not interact with it.

12 Claims, 3 Drawing Figures

RING SPINNING OR TWISTING MACHINE

BACKGROUND OF THE INVENTION

The invention relates to a ring spinning or ring twisting machine having at least one row of rotatably mounted spinning or twisting rings. More particularly, the invention relates to those machines having spinning rings that can be decelerated by means of eddy current brakes by cooperation of metallic flanges on the ring and stationary but displaceable permanent magnets which create eddy currents in the flange.

The spinning or twisting rings, henceforth only called rings, which are rotatably mounted, are normally carried on air bearings and are thus essentially friction free. The invention preferably relates to a known apparatus in which each rotatably mounted ring has associated with it a traveler that can revolve on the ring and which, because of the very high operational rpms, generally becomes stationary with respect to the ring on which it is mounted due to the centrifugal force pressing it against the ring. However, the invention is not limited to this preferred application, but it may also be used if the ring has a heel or an eye for the passage of the thread instead of having a traveler associated with it. In any case, the ring is driven in known manner by the thread which traverses the traveler or the heel or the eye in the direction of the wind-up spindle. In order to achieve a particular thread tension, it is required to be able to brake the ring with an adjustable amount of decelerating or braking torque. It is known to provide an eddy current brake of the above-described type in which the braking torque is changed by a vertical change of position of the magnets, i.e., a change of position in a direction parallel to the axis of rotation of the flange. However, such a displacement results in very large changes of the brake torque for very small changes of position of the magnet, so that, in practice, a precise setting or adjustment of the braking torque is impossible. Furthermore, this adjustment mechanism is relatively expensive and does not permit a simultaneous adjustment of all of the magnets on one machine side because of the great difficulties to achieve equal braking torques in all the different eddy current brakes.

OBJECT AND SUMMARY OF THE INVENTION

It is a principal object of the invention to provide a mechanism for changing the relative position of permanent magnets with respect to the flanges of the spinning ring so as to permit a stepless adjustment of the eddy current braking torque. It is a further object of the invention to provide an adjustment mechanism in which the braking torque is continuously adjusted as a function of a relatively long adjustment path of the permanent magnet so that, if necessary, all of the permanent magnet devices associated with an entire row of spinning rings may be displaced by a single mechanism. A precondition for this possibility, also achieved by the invention, is that all of the eddy current braking torques on all the rings of one side may be adjusted to be equal within relatively small limits. These and other objects are achieved, according to the invention, by providing that the permanent magnets are displaced, from a position in which they provide maximum eddy current braking torque, so that the effective magnetic field traversing the flange of the ring moves substantially sideways and in a plane containing the flange to a second position in which the eddy current braking effect is at a minimum.

This type of displacement of the individual permanent magnets permits a very sensitive adjustment of the eddy current braking torque because the braking torque changes only relatively slowly as a function of the path traversed by the permanent magnets. If necessary, it can be provided that each of the permanent magnets is individually and independently adjustable by merely carrying each magnet in a straight line bearing under a certain amount of friction so that it may be moved by hand or automatically after overcoming the bearing friction. Furthermore, the adjustment mechanism and the permanent magnet itself may be simply and securely attached to the ring rails of ordinary size because they require only relatively little space. In addition, no parts of the permanent magnet device and of the setting mechanism according to the invention protrude forward beyond the ring rail as this could lead to difficulties. Furthermore, the apparatus according to the invention is extremely well suited for adjusting all of the permanent magnet devices on one row of rings by means of a common setting mechanism and in synchronism, because the relatively long path required for changing the braking torque permits an adjustment of the individual effective torques at all of the rings to be equal within very tight limits. Furthermore, the entire permanent magnet device may be positioned in at least one location in which it exerts virtually no braking torque, i.e., the magnetic field does not traverse the flange of the ring.

It may be provided preferably that the permanent magnet device can be displaced in parallel with a plane which vertically intersects the geometric axis of rotation of the associated ring. Such a construction permits simple but exact changes of the position of the permanent magnets and therefore a sensitive and accurate adjustment of the effective braking torque. However, in some cases it would also be suitable to displace the permanent magnets, at least in a portion of their path, in a direction or directions which is or are inclined to the above-mentioned plane.

Preferably, the permanent magnet devices are displaceable along a straight line, which can be done both in individually adjustable magnet devices which can be changed independently of all the others, as well as in the common change of position of all of the permanent magnet devices associated with one row of rings.

Customary ring spinning or ring twisting machines have one row of rings on each long side of the machine and each row of these rings generally has a common ring rail. When the permanent magnet devices are to be displaced in common, it may be suitably provided to fasten them to a common rod which is itself displaceable in the longitudinal direction of the ring rail. Thus, the motion of an individual permanent magnet would be essentially tangential to its associated ring flange. However, in some cases, it might be more suitable to execute the linear motion at an angle or even perpendicular to the axis of the ring rail, for example due to space requirements. Even in the latter case, it is possible to provide either single or common displacement of the permanent magnets; the common displacement may take place, for example, by a push rod moving in the long direction of the ring rail and provided with oblique cam surfaces each of which cooperates with an oblique cam follower on one of the permanent magnets, where it might also be suitably provided that elastic means urge each of the magnets against the guide surfaces on the cam.

It is particularly advantageous if the flange of the ring in which the eddy currents are to be produced is flat, for this construction permits especially high braking torques and the permanent magnets may be so disposed that the maximum braking torque is exerted when the magnet is vertically above, or in some cases vertically below, the flange. The displacement of the magnet devices is preferably tangential to the flange of the ring but it is also possible to execute other motions at other angles up to a motion in the radial direction of each flange. In some cases, when the flange of the ring is flat, the poles of opposite magnetic polarity may be physically opposed to each other while the flange of the ring protrudes in the gap between the magnet poles when a braking torque is desired.

However, the flange may also be embodied differently, for example it might have a preferably cylindrical annular bulge for producing eddy currents and the permanent magnets might be disposed externally thereto and the magnetic poles so located that the magnetic field penetrates the annular bulge. In that case, the displacement of the permanent magnet devices would suitably take place in a direction different from the radial direction. However, in general, the highest braking torque achieved in such a construction is lower than that in which the ring flange is preferably embodied to be flat.

Even though it is particularly advantageous to displace the permanent magnet devices tangentially with respect to the ring flange, other types of displacement are in many cases suitable, especially if the permanent magnet devices are not moved in a straight line but are moved by pivoting about an axis.

It would be possible and advantageous to provide a single permanent magnet for each magnetic device but, in many cases, each device may have two or more permanent magnets if for example, the braking torque is to be made a particular function of the motion of the adjustment mechanism. For example, if it is desired to adjust a particular minimum braking torque very exactly, it is possible to provide two permanent magnets of different force, one of which provides the maximum braking torque while the other provides the minimum braking torque, only one of the magnets being effective at any one time.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
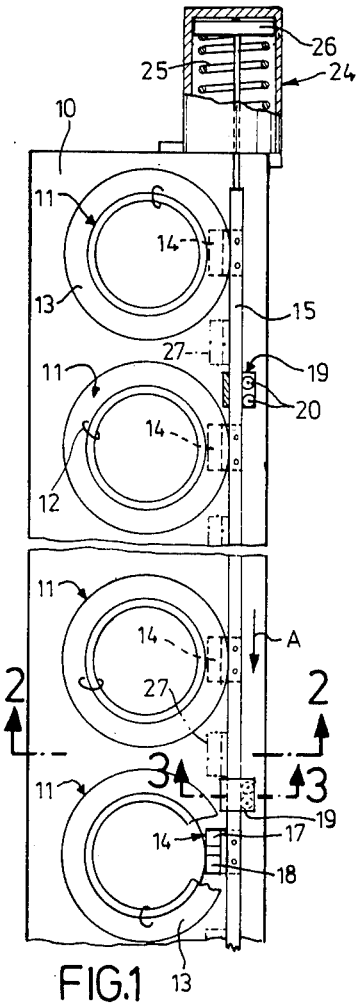
FIG. 1 of the drawing is a sectional top view of a portion of one side of a ring spinning machine in simplified form.
Figure 2:
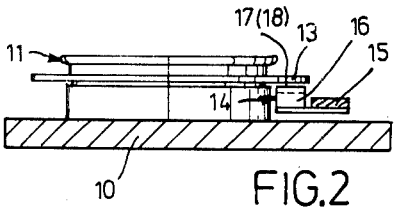
FIG. 2 is a sectional side view along the line 2—2 of FIG. 1.
Figure 3:
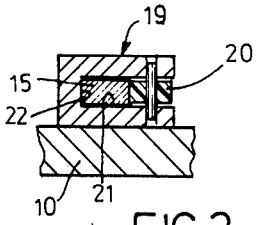
FIG. 3 is a sectional side view of the apparatus through the line 3—3 in FIG. 1.

Turning now to FIG. 1, there is shown a ring rail 10 which is equipped in known manner with a plurality of spinning or twisting rings 11, for example 200 rings, 11 lying in a row. In this preferred embodiment, these rings are carried on air bearings and each ring 11 is equipped with a traveler 12 which is traversed by the thread to be spun or twisted and to be wound up and, because of the rotation of the wind-up spindle, which is not shown, the thread drags the traveler 12. In turn, the traveler 12 rotates the associated ring 11. The rings 11 are all identical. Each ring in this preferred embodiment has a flat, rotationally symmetric, annular, disc-shaped flange 14 whose own axis coincides with the vertical, i.e., the geometrical rotational axis of the ring 11. A permanent magnet device 14, which is associated with each flange 13, creates therein eddy currents which tend to decelerate or brake the ring 11. In this preferred illustrated exemplary embodiment, all the permanent magnet devices 14 associated with a particular ring rail 10 are moved together by means of a single rod 15 which extends in parallel with the ring rail 10 and is movable along its longitudinal direction in a plane defined by the flanges 13. The permanent magnetic devices 14 are fixedly attached to the rod 15 at distances which correspond to the separation of individual rings. Each permanent magnetic device 14 has a single U-shaped permanent magnet 16, the top of which exposes a north pole and a south pole, the respective surfaces 17 and 18 thereof lying in a common horizontal plane. In the position of the rod 15 as shown, these permanent magnets 16 are located at very small and equal distances vertically below the associated flange 13, where they produce the same maximum braking torque. In each case, the plane containing a flange diameter and lying vertically with respect to the long axis of the ring rail 10 passes the exact center of the associated permanent magnet 16 between its two pole surfaces 17 and 18, which are of equal size.

The rail 15 is guided in fixed bearings 19 in an exactly linear manner and each bearing 19 has a lower horizontal gliding surface 21 and an associated straight vertical gliding surface 22, adjacent the rings 11, against which the rod 15 is always pressed by means of two elastically and rotatably disposed pressure rollers 20, thereby insuring exact linear but relatively easy movement of the rod 15. In this preferred embodiment, the rod 15 may be moved by a pneumatic or hydraulic piston cylinder unit 24 acting against the force of a restoring spring 25 in such a manner that the axial position of the piston 26 within the servo motor 24 also determines the position of the rod 15. The permanent magnetic devices 14 are displaced steplessly by the motion of the rod between two limiting positions, one of which is shown in continuous lines in FIG. 1, while the other is shown in dashed lines. The dashed position is laterally displaced from the flanges 13 so that the magnetic fields from the permanent magnetic devices 14 do not affect the flanges 13 and thus exert no braking torque and permit the unimpeded rotation of the rings.

When the servo motor 24 actuates the rod beginning at the maximum position of the magnetic devices 14 in the direction of the arrow A, the braking torque decreases continuously until it becomes zero in the vicinity of the dashed limiting position. Thus, a considerable length of setting path of the permanent magnetic devices 14 is required to change the braking torque in a continuous manner from maximum to zero, and this results in a favorable dependence of the braking torque on the setting path of the rod, permitting exact adjustments of the desired braking torque. Furthermore, the braking torque at each of the rings 11 in any position of the rod 15 may be made to be equal within very tight limits, thereby permitting the thread tension at all of the spinning locations or twisting locations to be made approximately equal, which is a great advantage and of great importance for uniform production and results in fewer thread breakages.

Thus, the illustrated eddy current brakes 13, 14 and the associated setting mechanism 15, 24 make possible a common adjustment of all of the permanent magnetic devices 14 associated with a ring rail 10, because they satisfy the condition that in all of the positions of the rod mechanism, the braking torques exerted on the rings 11 are approximately equal from one location to the next. The apparatus further permits a sensitive adjustment of any desired braking torque without requiring very close mechanical tolerances in the component parts. On the contrary, the mechanical tolerances may be made relatively loose which is very favorable from the point of view of inexpensive manufacture and, if necessary, individual adjustment of each magnet can be provided at each location.

The foregoing relates to a preferred embodiment of the invention, it being understood that numerous other embodiments and variants are possible within the spirit and scope of the invention, the latter being defined by the appended claims.

What is claimed is:

1. In a ring spinning or twisting machine which includes at least one row of rotatably mounted spinning or twisting rings having flanges, and including permanent magnet devices associated with the rings for generating eddy currents in said flanges when said rings are rotating to effect a reduction in the speed of rotation thereof, the improvement comprising:

movable carrier means for mounting thereon said permanent magnet devices, said carrier means being movably attached to said spinning machine so as to permit displacement of said permanent magnet devices in such a manner that the magnetic field from said permanent magnet devices penetrates said flanges in a first position during maximum eddy current generation and can be moved to at least one second position located substantially laterally adjacent to said flanges.

2. A machine as defined by claim 1, wherein said movable carrier means permits displacement of said permanent magnet devices in a plane which is perpendicular to the geometric axis of rotation of the associated spinning ring.

3. A machine as defined by claim 1, wherein said movable carrier means is so attached to said spinning machine that said permanent magnet device is movable substantially tangentially to the edge of its associated flange.

4. A machine as defined by claim 1, wherein said movable carrier means is capable of imparting to said permanent magnet device substantially straight line motion preferably parallel to a ring rail of said spinning machine.

5. A machine as defined by claim 1, wherein all of the said rings in said row of rings in said spinning machine are movable in common and in synchronism by said movable carrier means.

6. A machine as defined by claim 5, wherein said movable carrier means is a rod capable of straight line motion in bearings on which said permanent magnet devices are fixedly mounted.

7. A machine as defined by claim 1, wherein said flanges of said spinning rings are flat.

8. A machine as defined by claim 1, wherein said permanent magnet device is located substantially vertically below the associated flange when said magnetic field is in its first position of maximum eddy current generation.

9. A machine as defined by claim 1, wherein the pole faces of said permanent magnet devices lie in a common plane which is parallel to the plane of the flanges of said spinning rings.

10. A machine as defined by claim 1, wherein said permanent magnet device comprises a single permanent magnet.

11. A machine as defined by claim 1, wherein the poles of said permanent magnet in said permanent magnet device are disposed in line with the direction of motion of said movable carrier means.

12. A machine as defined by claim 1, wherein said flange has a cylindrical annular bulge and wherein said permanent magnet device cooperates with said bulge and is located externally thereto.

* * * * *